US006090467A

United States Patent [19]

Yip

[11] Patent Number: 6,090,467

[45] **Date of Patent: *Jul. 18, 2000**

[54] METHOD AND APPARATUS TO MANUFACTURE A TOWEL OR TISSUE STACK

[75] Inventor: Romuald Yip, Liverpool, Australia

[73] Assignee: Kimberly-Clark Australia Pty Limited, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/619,630

[22] PCT Filed: Oct. 7, 1994

[86] PCT No.: PCT/AU94/00609

§ 371 Date: Jul. 15, 1996

§ 102(e) Date: Jul. 15, 1996

[87] PCT Pub. No.: WO95/10476

PCT Pub. Date: Apr. 20, 1995

[30] Foreign Application Priority Data

Oct. 12, 1993 [AU] Australia ..... PM 1781

[51] Int. Cl.[7] ..... B32B 3/04

[52] U.S. Cl. ..... 428/121; 221/48; 270/39.01; 270/39.06; 270/39.07; 428/124; 428/126; 428/130; 493/430

[58] Field of Search ..... 428/121, 124, 428/126, 130; 270/39.06, 39.07, 39.01; 221/48; 493/430

[56] References Cited

U.S. PATENT DOCUMENTS

| | | | |
|---|---|---|---|
| 2,092,952 | 9/1937 | Campbell | 270/39 |
| 3,195,882 | 7/1965 | Nystrand | 270/83 |
| 3,338,575 | 8/1967 | Nystrand | 270/59 |
| 3,490,762 | 1/1970 | Nystrand | 270/59 |
| 3,572,681 | 3/1971 | Nystrand | 270/39 |
| 3,701,522 | 10/1972 | Chi | 270/39 |
| 3,709,077 | 1/1973 | Trogan et al. | 83/152 |
| 4,070,014 | 1/1978 | Takahashi | 270/39 |
| 4,163,548 | 8/1979 | Nystrand | 270/39 |
| 4,190,241 | 2/1980 | Krueger | 270/47 |
| 4,254,947 | 3/1981 | Trogan | 270/39 |
| 4,270,744 | 6/1981 | Trogan | 493/430 |
| 4,279,411 | 7/1981 | Nystrand | 270/39 |
| 4,475,730 | 10/1984 | Trogan | 270/41 |
| 4,494,741 | 1/1985 | Fischer et al. | 270/39 |
| 4,681,240 | 7/1987 | Wyant | 221/48 |
| 4,691,908 | 9/1987 | Bradley | 270/21.1 |
| 4,717,135 | 1/1988 | Hathaway | 270/39 |
| 4,770,402 | 9/1988 | Couturier | 270/39 |
| 4,778,441 | 10/1988 | Couturier | 493/425 |
| 4,917,665 | 4/1990 | Couturier | 493/472 |
| 5,088,707 | 2/1992 | Stemmler | 270/39 |
| 5,118,554 | 6/1992 | Chan et al. | 428/126 |
| 5,147,273 | 9/1992 | Rottmann et al. | 493/349 |

FOREIGN PATENT DOCUMENTS

| | | |
|---|---|---|
| 11735/88 | 2/1988 | Australia . |
| 16036/88 | 5/1988 | Australia . |
| 20273/88 | 8/1988 | Australia . |
| 1 225 594 | 3/1971 | United Kingdom . |

*Primary Examiner*—Nasser Ahmad
*Attorney, Agent, or Firm*—Graham & James LLP

[57] ABSTRACT

A tissue stack (10) including a plurality of discrete leaves (11–14), which each leaf including a pair of panels (15A) between which there is folded a pair of panels (15B) of the next adjacent leaf. There is also disclosed a machine and method for manufacturing the stack.

12 Claims, 4 Drawing Sheets

METHOD AND APPARATUS TO MANUFACTURE A TOWEL OR TISSUE STACK

TECHNICAL FIELD

The present invention relates to an apparatus and method to manufacture a towel or tissue stack, as well as the towel or tissue stack itself.

BACKGROUND OF THE INVENTION

Towels and tissues are stacked and delivered to a dispenser so that as each tissue is withdrawn from the box, the next tissue is moved to a position protruding from the apertures through which the towels or tissues are withdrawn. This action of delivering the next towel or tissue to a position protruding through the aperture is achieved by overlapping the folds of adjacent tissues in the tissue stack.

There are two constraints in the formation of a tissue stack. Firstly the portion protruding from the aperture must be of a size enabling the user to grasp the tissue. Also the portion extending from the dispenser must be of a sufficient size and therefore strength so that when it is gripped the tissue can be withdrawn from within the box without tearing of the tissue. The next constraint is the number of tissues contained within a stack to be located within the dispenser. If the tissue strength is increased so that the tissue does not rip as it is being withdrawn from within the box, the stack becomes too thick. It is therefore in some instances, desirable to minimise the thickness of the sheet in order to ensure that the stack contains a sufficient number of tissue sheets.

A first known tissue or towel stack includes adjacent tissues or towels overlapping by one panel only. In other instances, the tissues or towels consist of a single sheet but again the adjacent tissues are only overlapped by a single panel. In a still further configuration, again the tissues or towels are of a single thickness but overlap adjacent a fold only.

In the first two discussed stacks, each tissue consists of three folds. In the last mentioned stack, each tissue has three fold panels and two part panels.

The above discussed towel or tissue stacks suffer from the disadvantage that they do not provide a stack which is compact and therefore provides a desired number of towel or tissue sheets while at the same time providing towel or tissue sheets which can be withdrawn from within the dispenser regularly without tearing.

Commerically available machines that produce tissue or towel stack suffer from the disadvantage that they can only produce stacks of the above kind. They are provided with a lap roll spaced from a retard roll, but are driven at relative speeds so that the tissues or towels overlap as discussed above.

OBJECT OF THE INVENTION

It is the object of the present invention to overcome or substantially ameliorate the above disadvantages.

SUMMARY OF THE INVENTION

There is disclosed herein a tissue or towel stack comprising:

a plurality of discrete tissue or towel leaves, each leaf being folded so as to provide at least three tissue or towel panels, and wherein the leaves are folded back upon themselves so that each leaf has a first set of panels comprising two adjacent panels, which first set of panels is located between a second set of panels comprising two adjacent panels of an adjacent leaf.

Preferably there are six panels in each leaf.

There is also disclosed herein a method of producing a towel or tissue stack comprising the steps of:

providing a continuous web of towel or tissue material;

delivering the web to a cut off roll to transversely cut the web to form discrete towel or tissue leaves;

delivering the leaves from said cut off roll to a lap roll;

delivering the leaves from the lap roll to a retard roll so that each leaf has a leading portion overlapping a trailing portion of the preceding leaf, the leaves overlapping by a predetermined length;

delivering the leaves from the retard roll to a folding roll;

transversely folding each leaf at the fold roll to have at least three leaf panels, with overlapping portions of adjacent leaves being folded to form discrete panels such that each leaf has a first set of panels comprising two adjacent panels folded between a second set of panels comprising two adjacent panels of an adjacent leaf.

Preferably each leaf is folded to have six panels.

There is still further disclosed herein a machine to produce a towel or tissue stack, each stack having a plurality of leaves, with each leaf consisting of at least three panels, said machine comprising:

a cut off roll which receives a continuous web of towel or tissue material and transversely cuts the web to form discrete leaves of a predetermined length;

a lap roll to which the discrete leaves are delivered to arrange the leaves so that adjacent leaves overlap;

a retard roll cooperating with the lap roll to overlap adjacent leaves; and a folding roll assembly which transversely folds each leaf to form at least three panels, with overlapping portions of adjacent leaves forming discrete panels, and wherein the assembly is adapted so that each leaf is folded so as to have a first set of panels comprising two adjacent panels folded between a second set of panels comprising two adjacent panels of an adjacent leaf.

Preferably the above machine produces each leaf with six panels.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

The following embodiments describe two modifications to commercially available machines to manufacture tissue and towel stacks.

Figure 1:
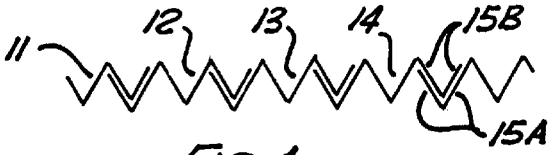
FIG. 1 is a schematic illustration of a tissue stack.

In FIG. 1 there is schematically depicted a towel or tissue stack 10. The stack 10 may include, but is not limited to, creped cellulose tissues and towels, non-creped cellulose tissues and towels, nonwoven wipers (e.g., synthetic nonwoven materials such as meltblown fabrics, spunbond fabrics and combinations thereof) and cellulose/nonwoven composite wipers.

The stack 10 contains a plurality of discrete leaves including leaves 11 to 14. Each leaf 11 to 14 includes six panels 15 including the leading panels 15A and the trailing panel 15B. The stack 10 is arranged so that the pair of trailing panels 15B overlap (i.e., are folded and nested between) the leading panels 15A of the next trailing leaf. Generally speaking, at least one trailing panel 15B should overlap the leading panel 15A of the next trailing leaf. In some situations, a single panel overlap may help avoid dispensing multiple leafs when a single leaf is pulled from a dispenser. In other situations, higher levels of panel overlap may be appropriate. For example, two, three or more panels may be overlapped. It is contemplated that an ability to overlap from more than two panels up to about 50% of the total length of the leaf may enhance dispensing of large towels from a variety of dispensers such as, for example, recessed dispensers.

The panels 15 are of substantially the same width or size, although this is not essential. Generally speaking, each panel has a width which may be characterised as the distance between individual folds running across the each leaf 11 to 14. The width of the panels 15 may range from about 1 inch to about 5 inches. Desirably, the width of the panels 15 may range from about 2 inches to about 4 inches. More desirably, the width of the panels may be about 3.75 inches.

Figure 2:
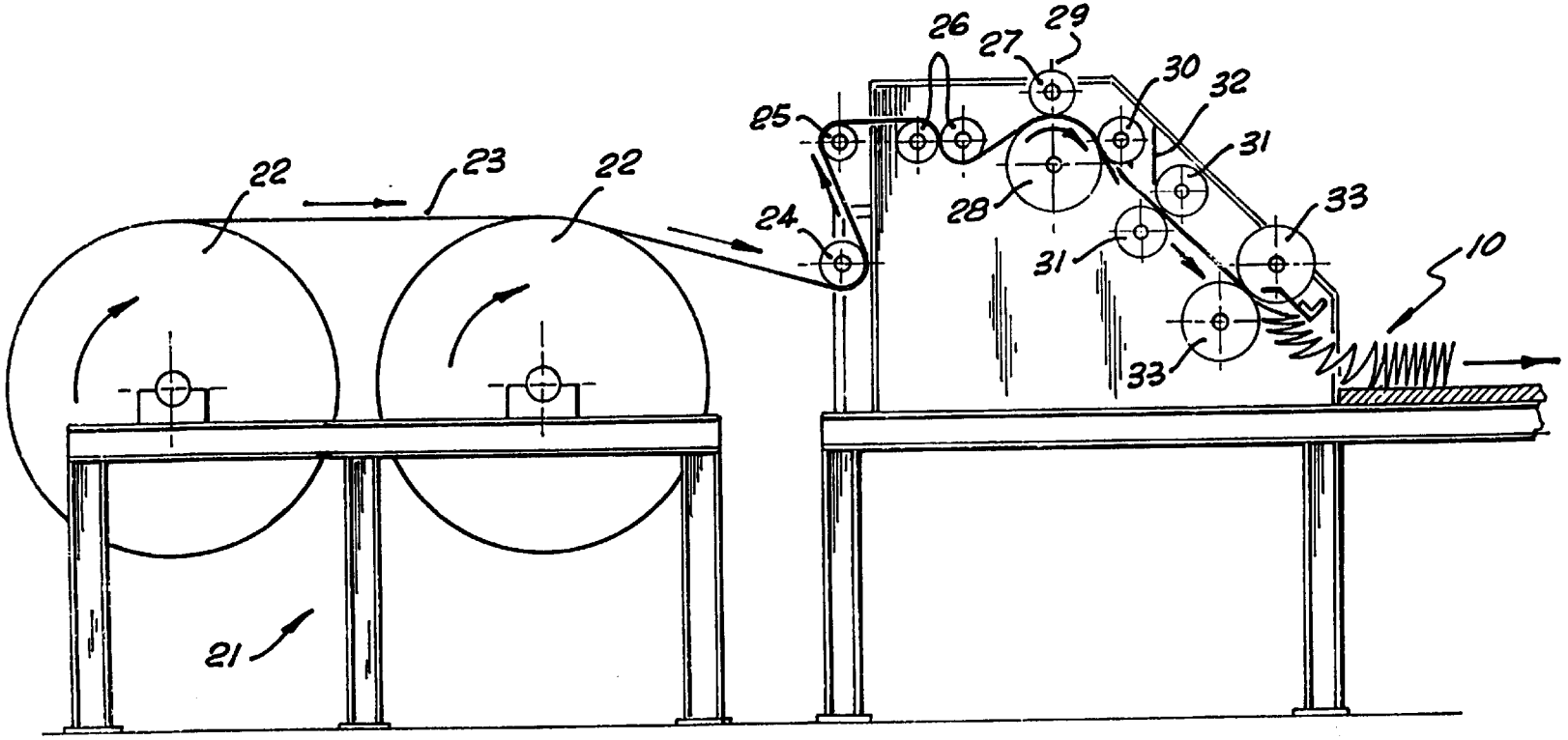
FIG. 2 is a schematic side elevation of a machine to produce the tissue stack of FIG. 1.
Figure 4:
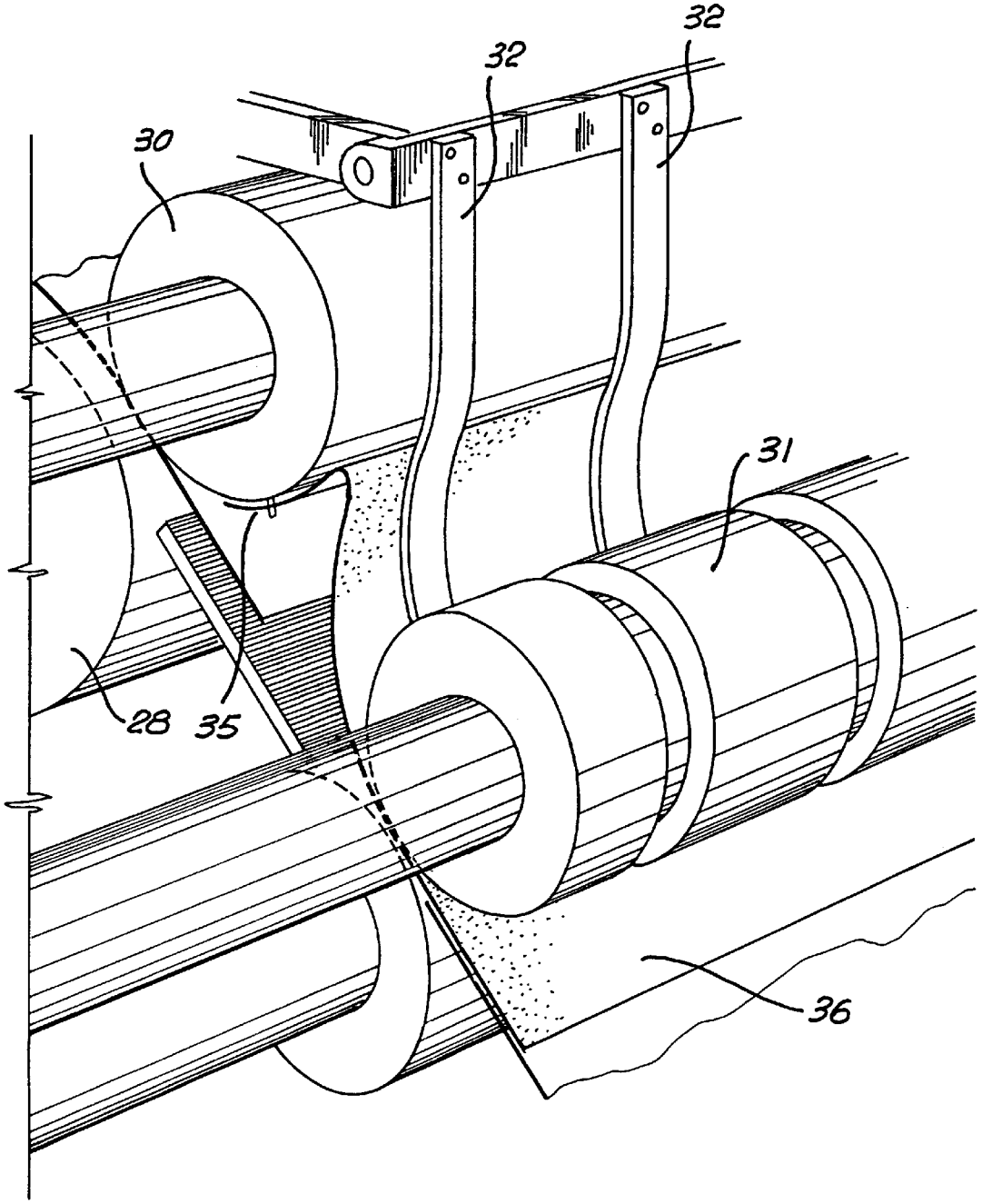
FIGS. 4 and 5 are schematic perspective views of the lap roll and retard roll of the machine of FIG. 2.
Figure 5:
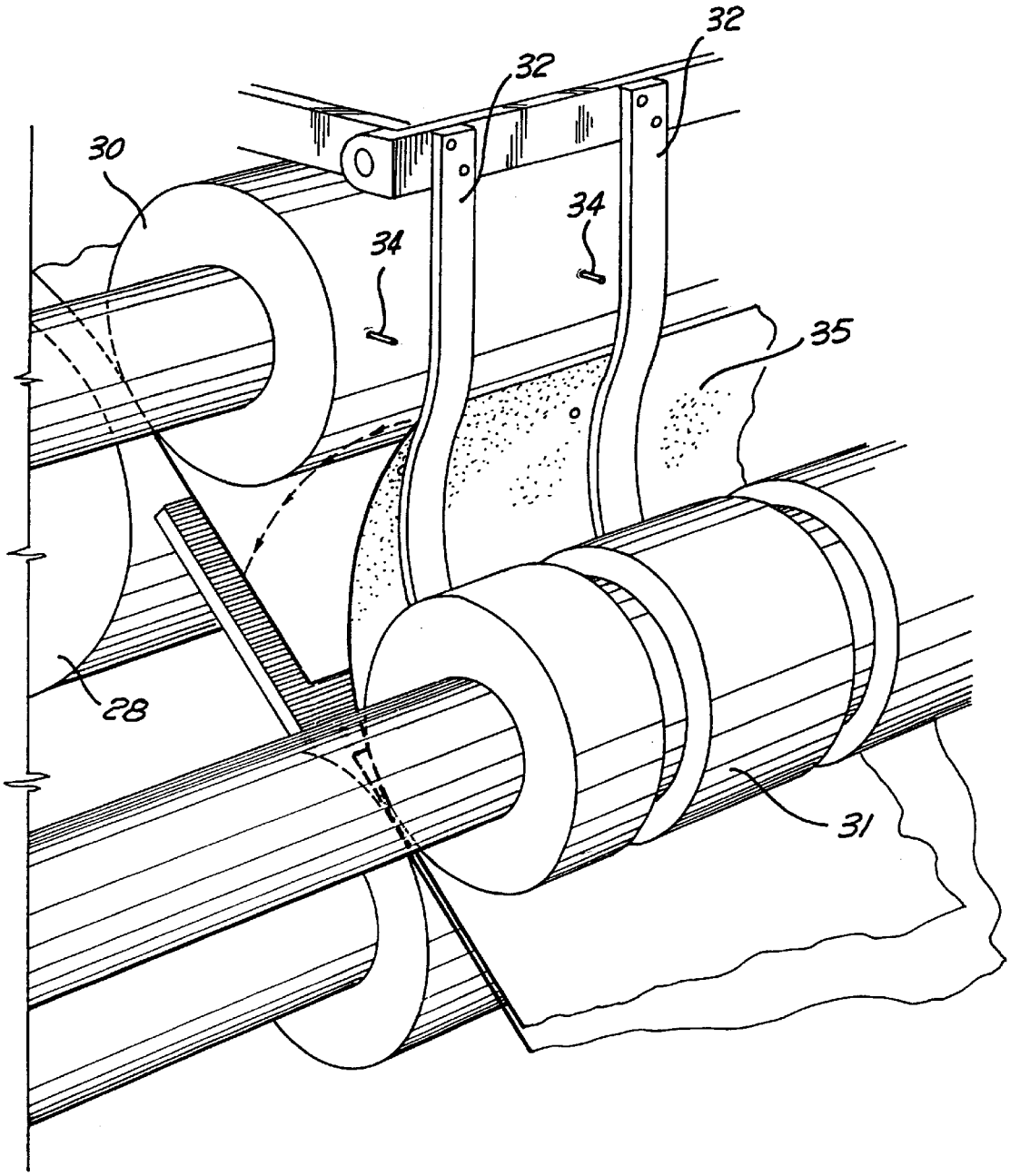

In FIGS. 2, 4 and 5, there is schematically depicted a machine 20 to manufacture the towel or tissue stack 10 of FIG. 1. The machine 20 includes a rack 21 which receives one or more rolls 22 of towel or tissue web 23 so that a continuous web 23 is delivered to a guide roll 24. From the guide roll 24, the web 23 is delivered to a guide bar 25 and then subsequently to pull rolls 26. From the pull rolls 26, the web 23 is delivered to a cut off roll 27 which cooperates with a cut off bed roll 28. The cut off roll 27 has a cutting blade 29 which cuts discrete leaves from the web 23 delivered thereto. Accordingly for each rotation of the cut off roll 27, there is one discrete leaf produced. The leaves are of substantially identical size and shape.

Also acting with the cut off bed roll 28 is a lap roll 30. The lap roll 30 has a set of pins 34 which pass through the tail 35 of each leaf and into clearance slots in the cut off bed roll as they pass through the nip between the lap roll 30 and the cut off bed roll 28. As the pins 34 puncture the tail 35 of the leaf, the leading edge 36 of the sheet enters the nip between the retard rolls 31. The retard rolls 31 have a slower peripheral speed than the lap roll 30. As the pins 34 of the lap roll 30 rotate towards the retard rolls 31, the leaf is trapped below the guide fingers 32 so that the tail end 34 of the leaf is forced to "buckle" upward. As the tail 35 of the leaf and pins 34 of the lap roll 30 lift from the cut off bed roll 28, the next leaf is travelling forward at a slightly higher speed than the immediately preceding leaf and therefore the next leaf passes under the preceeding leaf so as to overlap therewith. As the leaf which is engaged with the retard rolls 31 is pulled forward, its tail 35 is pulled from the pins 34 of the lap roll 30 and therefore the leaf falls down on top of the trailing leaf.

The leaves overlap so there are effectively three leaves at least partly positioned between the retard rolls 31 and the lap rolls 30. In this regard it should be appreciated that the fingers 32 permit location of the leaves in the gap between the retard rolls 31 and the lap roll 30 by the method discussed, that is buckling of the leaves. To operate effectively, the retard rolls 31, lap roll 30 and fingers 32 are configured so that there can be located therebetween a length of tissue equal one leaf, that is six panels.

The overlapping leaves are then delivered to folding rolls 33 which transversely fold the leaves so that the overlapping leaf portions form discrete leaf panels with each leaf having two adjacent leaf panels folded between two adjacent panels of an adjacent leaf. In this example each roll 33 has two "tuckers" and two "grippers". The "tuckers" and "grippers" are alternately located about the rolls 33, at equal angular displacements. Therefore with each rotation of the rolls 33, six panels are formed if one leaf is considered.

The degree of overlap between adjacent leaves is governed by the feed rate of the web 23 (which is the same as the peripheral speeds of the rolls 24 to 30) is relative to the slower peripheral speed of the retard rolls 31. The overlap is also determined by the number of blades on the roll 27.

From the folding rolls 33, a stack 10 is produced. Portions of the stack 10 are then taken and placed in a typical towel or tissue dispenser or wrapped.

Figure 3:
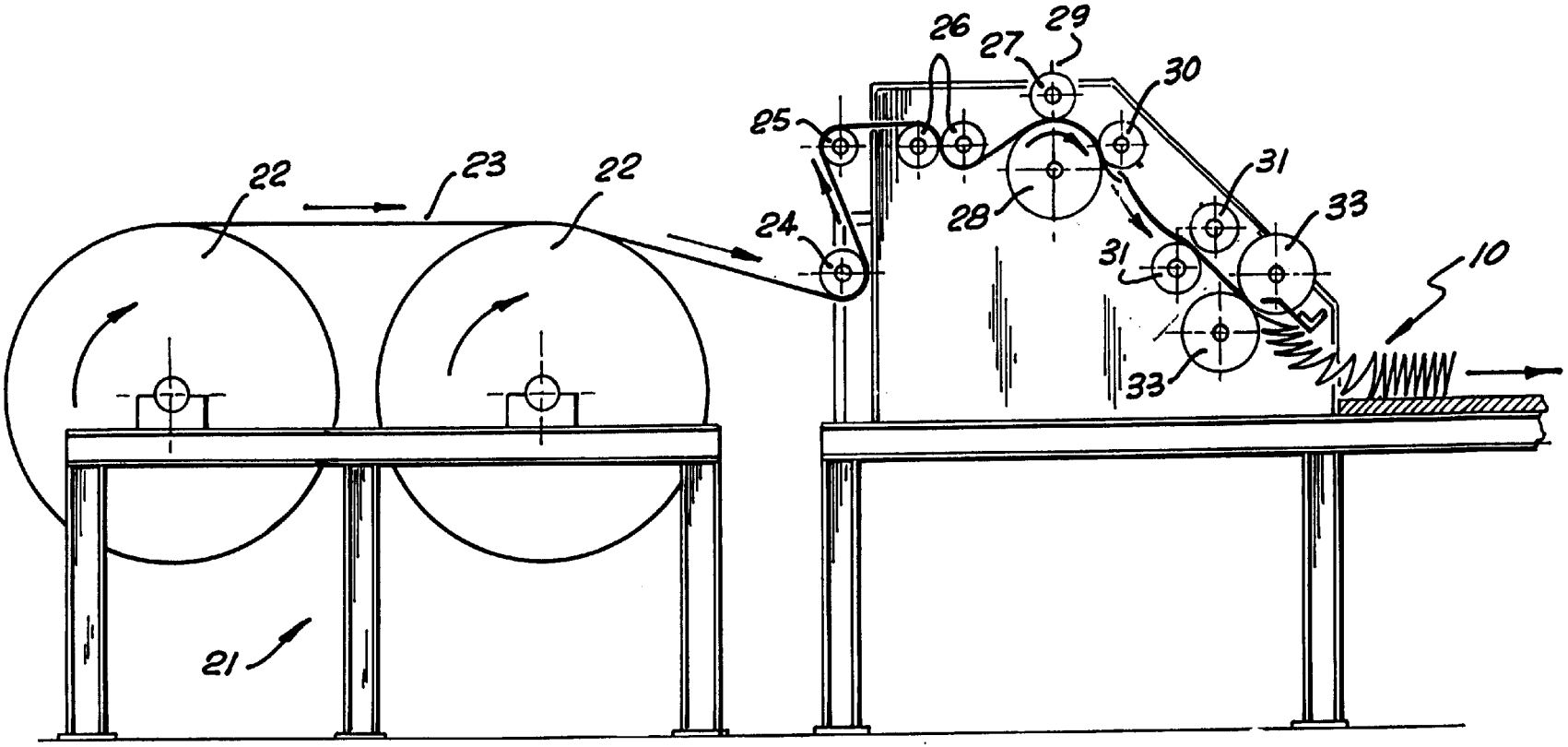
FIG. 3 is a further machine to manufacture the tissue stack of FIG. 1.

In FIG. 3 the machine 20 has been modified. Rather than being provided with fingers 32, the lap roll 30 has been spaced from the retard rolls 31 a distance such that buckling of the leaves is not required. That is, the spacing between the lap roll 30 and retard rolls 31 is such as to accommodate an effective length of tissue or towel equal to one leaf, that is a distance of six panels. In this instance the tail end of each leaf is lifted by the lap roll 30 so that the next following leaf has a leading portion inserted below the tail end of the next formed leaf. The trailing portion is removed from the pins of the lap roll 30 by metal strips which "peel" the leaves from the lap roll 30.

It should be appreciated that the above machine 20 could be configured so that adjacent leaves overlap by three or more panels.

What is claimed is:

1. A tissue or towel stack comprising:

a plurality of discrete tissue or towel leaves, each leaf folded so as to provide at least three tissue or towel panels, the leaves being folded back upon themselves so that each leaf has a first set of panels which consists of an end panel and at least the next adjacent panel, which first set of panels is overlappingly located between a second set of panels that consists of an end panel and at least the next adjacent panel of an adjacent folded leaf, and wherein the leaves are substantially identical, and the panels of each leaf are substantially the same size and configuration.

2. The tissue or towel stack of claim 1, wherein each leaf is generally square or rectangular and is folded about parallel lines parallel to a side of the leaf, with the end panel of the first set being at one end of the leaf, and the end panel of the second set of that leaf being at the opposite end to said one end.

3. The tissue or towel stack of claim 2, wherein each leaf has six panels so that each leaf has its first set of panels spaced from said second set of panels by two panels.

4. A method of producing a towel or tissue rack comprising the steps of:

providing a continuous web of towel or tissue material;

delivering the web to a cut off roll to transversely cut the web to form discrete towel or tissue leaves;

delivering the leaves from said cut off roll to a lap roll;

delivering the leaves from the lap roll to a retard roll so that each leaf has a leading portion overlapping a trailing portion of the preceding leaf, the leaves overlapping by a predetermined length;

delivering the leaves from the retard roll to a folding roll;

transversely folding each leaf at the fold roll to have at least three leaf panels, with overlapping portions of adjacent leaves being folded to form discrete panels such that each leaf has a first set of panels which consists of an end panel and at least the next adjacent panel folded between a second set of panels that consists of an end panel and at least the next adjacent panel of an adjacent folded leaf, and wherein the leaves are substantially identical, and the panels of each leaf are substantially the same size and configuration.

5. The method of claim 4, wherein the step of delivering the leaves from said lap roll to said retard roll includes causing adjacent leaves to have overlapping portions to provide said first set and said second set upon folding.

6. The method of claim 5, wherein the step of delivering the leaves from said lap roll to said retard roll further includes moving the leaves along a predetermined path, raising a trailing portion of each leaf as it leaves the lap roll so the next following leaf advances further along said path so that upon said trailing portion returning to said path, said trailing portion overlaps a leading portion of said next adjacent leaf.

7. The method of claim 4, wherein the cut off roll transversely cuts the web so that the leaves are of square or rectangular configuration, and the step of transversely folding each leaf includes folding each leaf so that the panels are substantially identical and so that each leaf is folded about parallel lines parallel to a side of the leaf, with the end panel of the first set being at one end of the leaf, and the end panel of the second set of that leaf being at the opposite end to said one end.

8. A machine to produce a towel or tissue stack, each stack having a plurality of leaves, with each leaf consisting of at least three panels, said machine comprising:

a cut off roll which receives a continuous web of towel or tissue material and transversely cuts the web to form discrete leaves of a predetermined length;

a lap roll to which the discrete leaves are delivered to arrange the leaves so that adjacent leaves overlap;

a retard roll cooperating with the lap roll to overlap adjacent leaves; and a folding roll assembly which transversely folds each leaf to form at least three panels, with overlapping portions of adjacent leaves forming discrete panels, and wherein the machine is configured to accommodate one of the leaves between the lap roll and the retard roll so that said folding roll assembly folds each leaf so as to have a first set of panels which consists of an end panel and at least the next adjacent panel folded between a second set of panels that consists of an end panel and at least the next adjacent panel of an folded adjacent leaf, with the leaves being substantially identical and the panels of each leaf being substantially the same size and shape.

9. The machine of claim 8, wherein the lap roll raises the trailing portion of each leaf so that the leading portion of the next leaf can be located beneath the raised trailing portion.

10. The machine of claim 9, wherein the lap roll and retard roll are spaced by a distance less than said predetermined length.

11. The machine of claim 10, further including fingers located between the lap roll and retard roll against which the leaves buckle under the action of the lap roll forcing the leaves against the fingers.

12. The machine of claim 11, wherein the lap roll and retard roll are spaced by a distance approximately equal to said predetermined length.

* * * * *